US007612742B2

(12) United States Patent
Lee et al.

(10) Patent No.: US 7,612,742 B2
(45) Date of Patent: Nov. 3, 2009

(54) PLASMA DISPLAY PANEL AND DRIVING METHOD THEREOF

(75) Inventors: Dong-Young Lee, Chunan-si (KR); Byung-Gwon Cho, Chunan-si (KR); Heung-Sik Tae, Chunan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 735 days.

(21) Appl. No.: 11/406,772

(22) Filed: Apr. 18, 2006

(65) Prior Publication Data

US 2006/0232513 A1 Oct. 19, 2006

(30) Foreign Application Priority Data

Apr. 19, 2005 (KR) ..... 10-2005-0032338

(51) Int. Cl.
*G09G 3/28* (2006.01)

(52) U.S. Cl. ..... 345/68; 345/60; 345/61; 345/62; 345/63; 345/64; 345/65; 345/66; 345/67

(58) Field of Classification Search ..... 345/60–68
See application file for complete search history.

(56) References Cited

U.S. PATENT DOCUMENTS

2003/0122735 A1* 7/2003 Huang et al. ..... 345/60
2004/0233128 A1* 11/2004 Choi et al. ..... 345/60
2004/0239589 A1* 12/2004 Nishimura et al. ..... 345/60

FOREIGN PATENT DOCUMENTS

KR 10-2004-0099054 11/2004

OTHER PUBLICATIONS

Korean Patent Abstracts, Publication No. 1020040099054 A, dated Nov. 26, 2004, in the name of Sung II Chien et al.

* cited by examiner

*Primary Examiner*—Richard Hjerpe
*Assistant Examiner*—Saifeldin Elnafia
(74) *Attorney, Agent, or Firm*—Christie, Parker & Hale, LLP

(57) ABSTRACT

In a plasma display panel, a sustain discharge pulse voltage is applied to the scan or sustain electrodes while the address electrode is biased with a ground voltage, and a negative assistant pulse voltage is applied to an electrode that is not receiving the sustain discharge pulse. At least a part of a period for applying the negative assistant pulse is positioned prior to a period of applying the sustain discharge pulse. Discharge efficiency can be improved by applying the negative assistant voltage to the sustain electrode when the sustain discharge is applied to the scan electrode across a long discharge gap.

20 Claims, 7 Drawing Sheets

PLASMA DISPLAY PANEL AND DRIVING METHOD THEREOF

CROSS-REFERENCE TO RELATED APPLICATION

This application claims priority to and the benefit of Korean Patent Application No. 10-2005-0032338 filed in the Korean Intellectual Property Office on Apr. 19, 2005, the entire content of which is incorporated herein by reference.

BACKGROUND OF THE INVENTION (a) Field of the Invention

The present invention relates to a plasma display device and a driving method thereof.

(b) Description of the Related Art

Development of flat panel displays, such as liquid crystal displays (LCD), field emission displays (FED), and plasma display panels (PDP), has been actively pursued in the recent years. The PDP is advantageous over other flat panel displays due to its high luminance, high luminous efficiency, and wide viewing angle. Accordingly, the PDP is in the spotlight as a substitute for the conventional cathode ray tube (CRT) for large-screen displays of more than 40 inches.

The PDP may be an AC PDP or a DC PDP based on the method used for driving the PDP. The DC PDP has electrodes exposed to a discharge space, thereby causing current to directly flow through the discharge space during application of a voltage to the DC PDP. In this regard, the DC PDP has a disadvantage in that it requires a resistor for limiting the current. On the other hand, the AC PDP has electrodes covered with a dielectric layer that naturally forms a capacitance component to limit the current and protect the electrodes from the impact of ions during discharge. As a result, the AC PDP lasts longer than the DC PDP.

The PDP is driven during frames of time One frame of the AC PDP is divided into a plurality of subfields each having a respective weight. Each subfield includes a reset period, an address period, and a sustain period.

The reset period is for initializing the status of each discharge cell to facilitate an addressing operation on the discharge cell. The address period is for selecting turn-on/turn-off cells (i.e., cells to be turned on or off) and accumulating wall charges in the turn-on cells (i.e., addressed cells). The sustain period is for sustaining a discharge in the addressed cells for displaying an image.

FIG. 1 is a driving waveform diagram of a conventional plasma display device. During the sustain period, a voltage Vs is alternately applied to a scan electrode Y and a sustain electrode X while an address electrode A is biased with a reference voltage (0V in FIG. 1).

During the sustain period, the voltage Vs is applied to the scan electrode Y and a sustain discharge is generated between the scan electrode Y and the sustain electrode X. Accordingly, negative (−) wall charges and positive (+) wall charges are respectively formed on the scan electrode Y and the sustain electrode X. However, when the sustain discharge is generated, the positive (+) wall charges are distributed to the sustain electrode X as well as the address electrode A. Accordingly, the amount of positive (+) wall charges formed on the sustain electrode X will not be sufficiently large to generate a next sustain discharge that is adequate, thereby causing a decrease of luminous efficiency.

Various studies have been conducted in order to improve the luminous efficiency. In one study, a discharge gap of approximately 60 μm to 120 μm (hereinafter referred to as a "short discharge gap") is formed between a scan electrode and a sustain electrode located within one discharge cell. The discharge cell structure in which the aforementioned short discharge gap is generated has limitations that prevent significant improvement of luminous efficiency. To overcome these limitations, a new discharge cell structure and accordingly a new driving method have been considered. For example, a technology using positive column discharge characteristics has been researched. According to the technology, a discharge gap of 400 μm or greater in size (a so-called "long discharge gap") is formed between the scan electrode and the sustain electrode located within one discharge cell, and a positive column discharge is generated in the long discharge gap. However, there is a problem in that a discharge firing voltage and a sustain discharge voltage (Vs) are increased in order to generate the positive column discharge for improving luminous efficiency.

SUMMARY OF THE INVENTION

Embodiments of the present invention provide a plasma display device and a driving method for the plasma display device for solving the above-mentioned problem and improving luminous efficiency.

An exemplary driving method according to an embodiment of the present invention is used to drive a plasma display device including a plurality of first electrodes, a plurality of second electrodes, and a plurality of third electrodes formed in a direction crossing a direction of the first and second electrodes. A distance between the first electrodes and the second electrodes is greater than a distance between the first electrodes and the third electrodes.

The plasma display device is driven during a plurality of subfields divided from a frame. Each subfield includes a reset period, an address period, and a sustain period.

During the sustain period, a voltage falling from a first voltage to a second voltage is applied to the second electrode while the third electrode is biased with the first voltage. The second voltage is applied to the second electrode for a predetermined period and a voltage rising to the third voltage is applied to the second electrode after the application of the falling voltage to the second electrode is terminated. A fourth voltage is applied to the first electrode for generating a sustain discharge at a given point of the predetermined period.

Another exemplary driving method according to an embodiment of the present invention drives a plasma display device including a plurality of first electrodes, a plurality of second electrodes, and a plurality of third electrodes formed in a direction crossing a direction of the first and second electrodes.

A sustain period is divided into a plurality of sub-periods, and each sub-period generates a sustain discharge.

In this driving method, during a first sub-period, a trigger discharge is generated between the first electrode and the third electrode by applying a second voltage that is lower than a first voltage to the first electrode while the third electrode is biased with the first voltage. A discharge may be diffused along the third electrode and a main discharge may be generated between the second and first electrodes by applying a third voltage that is higher than the first voltage to the second electrode at the time of starting a second period that excludes a predetermined first period in which the first electrode is maintained at the second voltage.

In addition, the second period occurs after the first period, and a sum of the first period and the second period is less than a third period during which the third voltage is applied to the second electrode.

An exemplary plasma display device according to an embodiment of the present invention includes a plasma display panel (PDP) and a chassis base. The PDP includes a first substrate, a plurality of address electrodes formed on the first substrate, a second substrate located opposite to the first substrate, and a plurality of pairs of scan and sustain electrodes formed in parallel on the second substrate. The chassis base is located opposite to the PDP and includes a driving board for transmitting driving signals for the address electrodes, the scan electrodes, and the sustain electrodes.

During a sustain period, the driving board applies a second voltage that is lower than a first voltage to the sustain electrode and applies a third voltage that is higher than the first voltage to the scan electrode at a given point during the application of the second voltage, while the address electrode is biased with the first voltage.

One embodiment presents a driving method for a plasma display device. The plasma display device has a plurality of first electrodes, a plurality of second electrodes, and a plurality of third electrodes formed in a direction crossing a common direction of the first electrodes and the second electrodes. The first electrodes may be sustain electrodes, the second electrodes may be scan electrodes, and the third electrodes may be address electrodes. A gap formed between the first electrodes and the second electrodes is greater than both a distance between the first and third electrodes and a distance between the second and third electrodes. The driving time of the plasma display device is divided into periods including a sustain period for sustaining a discharge generated within a plasma display panel of the plasma display device. The sustain period is divided into a plurality of sub-periods. Each sub-period has a first time interval, a second time interval, and a third time interval that are consecutive. The driving time of the plasma display device may be divided into frames of time. Each frame is divided into a plurality of subfields that each include a reset period, an address period, and the sustain period.

During a first sub-period of the sustain period, the driving method includes maintaining the third electrodes at a first voltage, that may be a ground voltage. While the first electrodes are continuously maintained at the first voltage during the entire sustain period, voltage of a first electrode is lowered from the first voltage to a second voltage during a first time interval of the first sub-period of the sustain period. Then the first electrode is kept at the second voltage for duration of a second time interval of the first sub-period. Next, the voltage of the first electrode is raised from the second voltage to a third voltage during a third time interval of the first sub-period. The third voltage may also be a ground voltage. Then, voltage of a second electrode is raised from the first voltage to a fourth voltage during the second time interval of the first sub-period. The first electrode is kept at the third voltage and the second electrode is kept at the fourth voltage during the third time interval for duration of a first overlap interval. While the early changes in the voltages of the electrodes initiate and diffuse a discharge, during this overlap interval, a main discharge is sustained between the first and second electrodes. The third voltage is lower than the fourth voltage. The first overlap interval, when the main discharge occurs, is longer than a sum of the first time interval and the second time interval during which the discharge is triggered and diffused. The second voltage may be a negative voltage and the fourth voltage may be a positive voltage.

During a second sub-period of the sustain period, where the second sub-period comes either before or after the first sub-period, the driving method is similar to the driving method of the first sub-period with the difference that the waveforms being applied to the first and second electrodes are switched with each other. The third electrodes or the address electrodes remain at the first voltage or the ground voltage at all times during the sustain period and do not change from sub-period to sub-period. Otherwise, during the second sub-period, a voltage of the second electrode is lowered from the first voltage to the second voltage during a first time interval of the second sub-period, the second electrode is maintained at the second voltage for duration of a second time interval of the second sub-period, the voltage of the second electrode is raised from the second voltage to the third voltage during a third time interval of the second sub-period, the voltage of the first electrode is raised from the first voltage to the fourth voltage during the second time interval of the second sub-period, and the second and first electrodes are maintained at the third and fourth voltages, respectively, for duration of a second overlap interval that occurs during the third time interval of the second sub-period. The second overlap interval is again longer than a sum of the first and second time intervals because the main discharge is intended to occur during the overlap periods.

DETAILED DESCRIPTION OF THE EMBODIMENTS

Wall charges mentioned in the following description mean charges formed and accumulated on a wall (e.g., a dielectric layer) close to an electrode of a discharge cell. In addition, a wall charge will be described as being "formed" or "accumulated" on the electrode, although the wall charges do not actually touch the electrodes. Further, a wall voltage means a potential difference formed on the wall of the discharge cell by the wall charge.

Structure of a plasma display device according to an exemplary embodiment of the present invention will be described with reference to FIG. 2 to FIG. 6.

Figure 1:
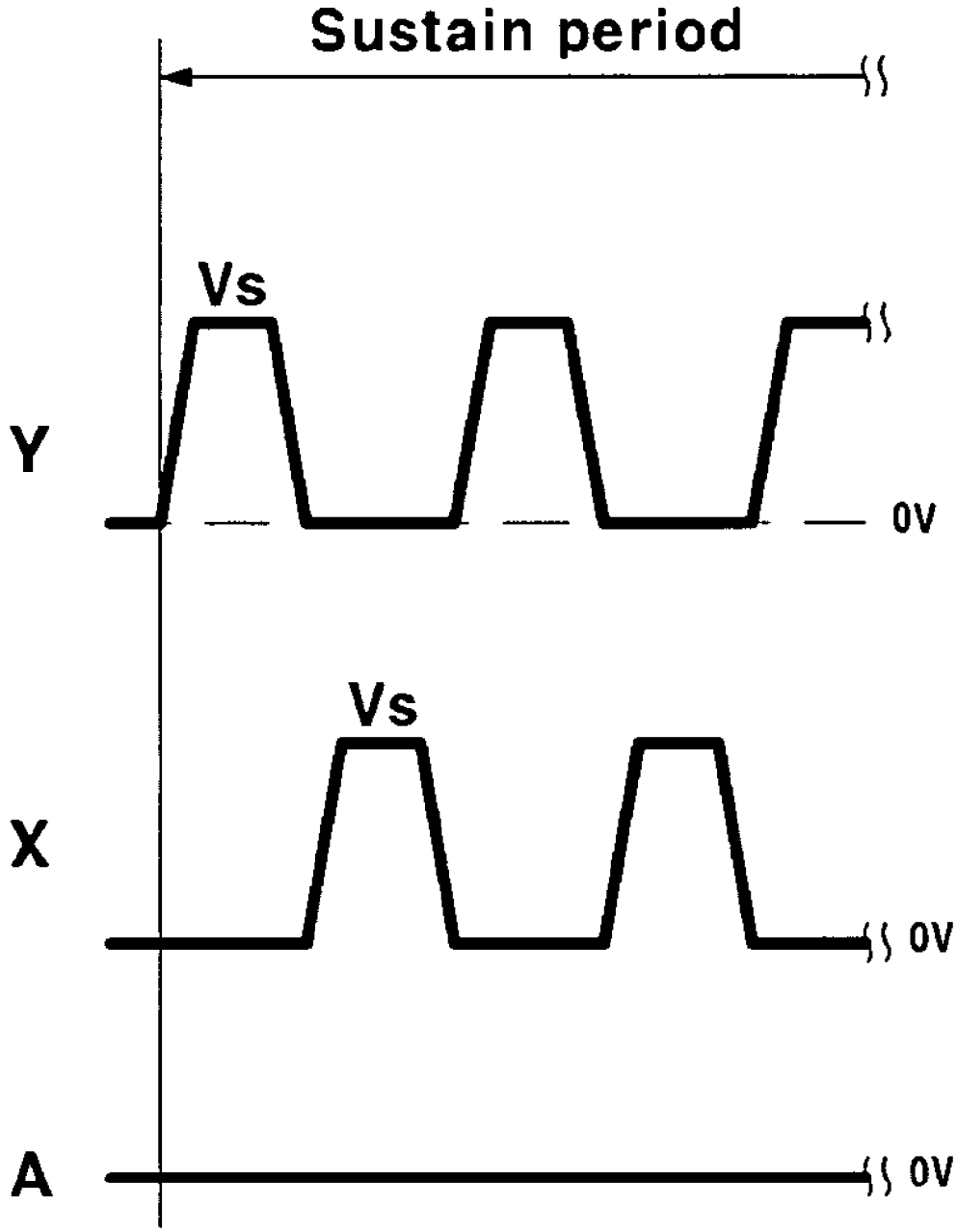
FIG. 1 (Prior Art)
FIG. 1 is a driving waveform diagram of a conventional plasma display device.
Figure 2:
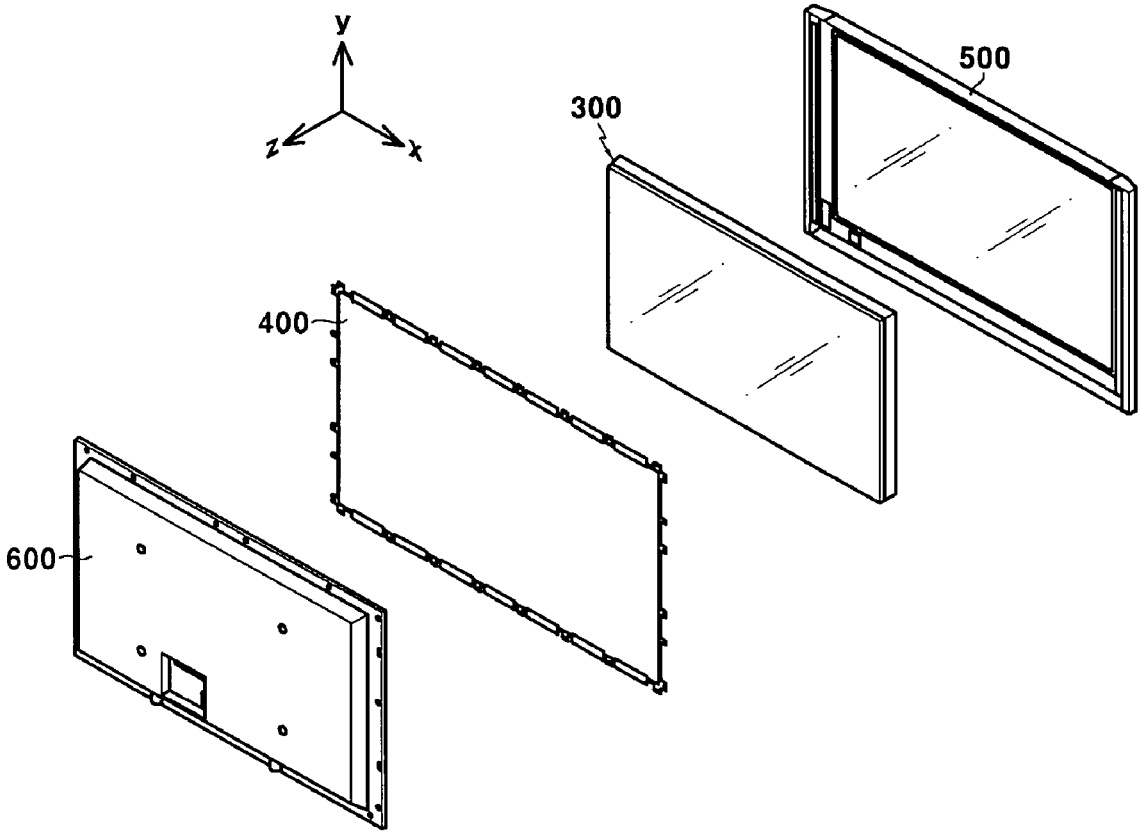
FIG. 2 is an exploded perspective view of a plasma display device according to an exemplary embodiment of the present invention.

As shown in FIG. 2, a plasma display device includes a plasma display panel (PDP) 300, a chassis base 400, a front case 500, and a rear case 600. The chassis base 400 is coupled to the PDP 300 opposite an image display side of the PDP 300. The front case 500 is coupled to the PDP 300 on the image display side of the PDP 300, and the rear case 600 is coupled to the chassis base 400. The assembly of these parts forms a plasma display device.

Figure 3:
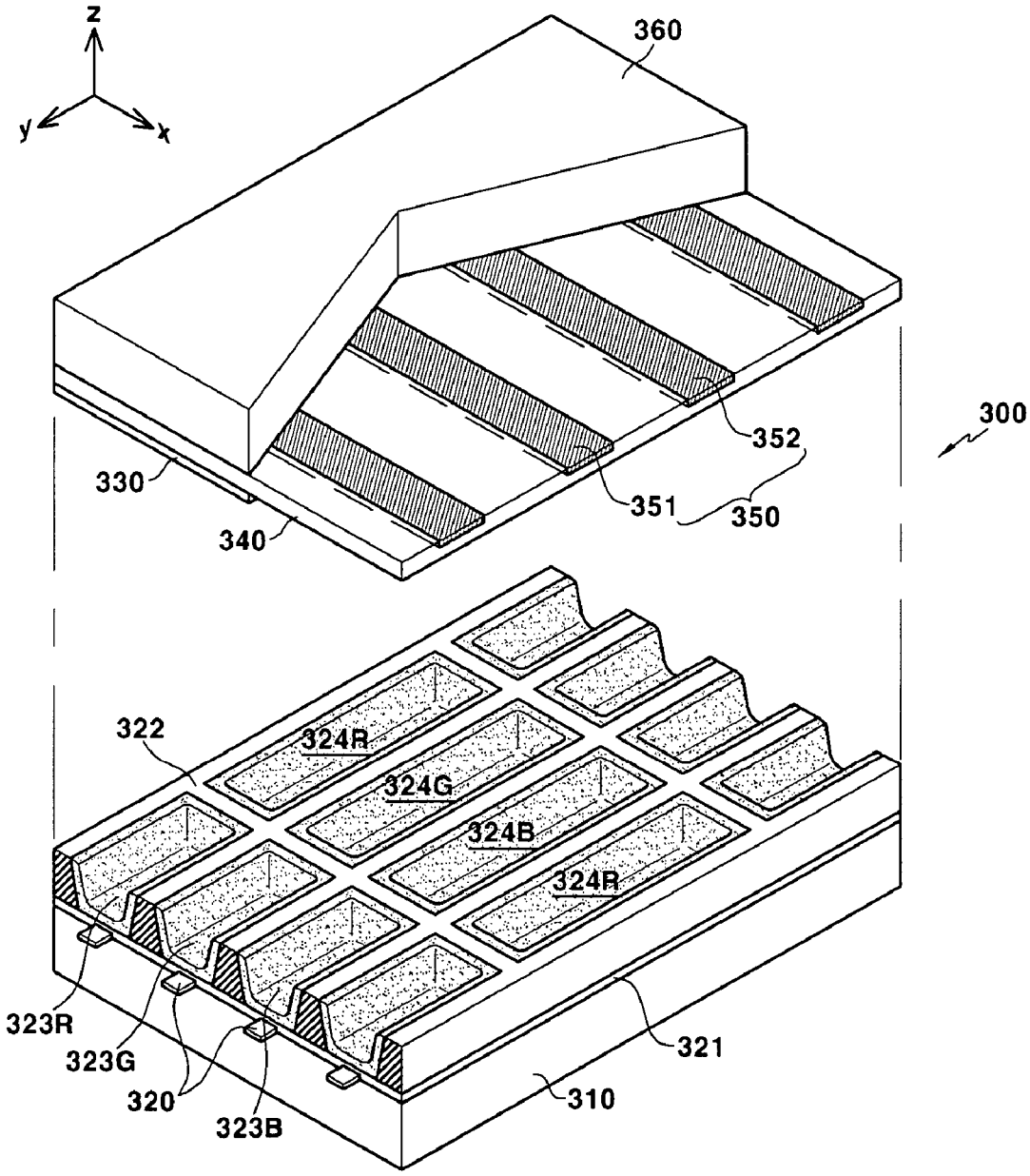
FIG. 3 is a partially exploded perspective view of a plasma display panel (PDP) according to an exemplary embodiment of the present invention.
Figure 4:
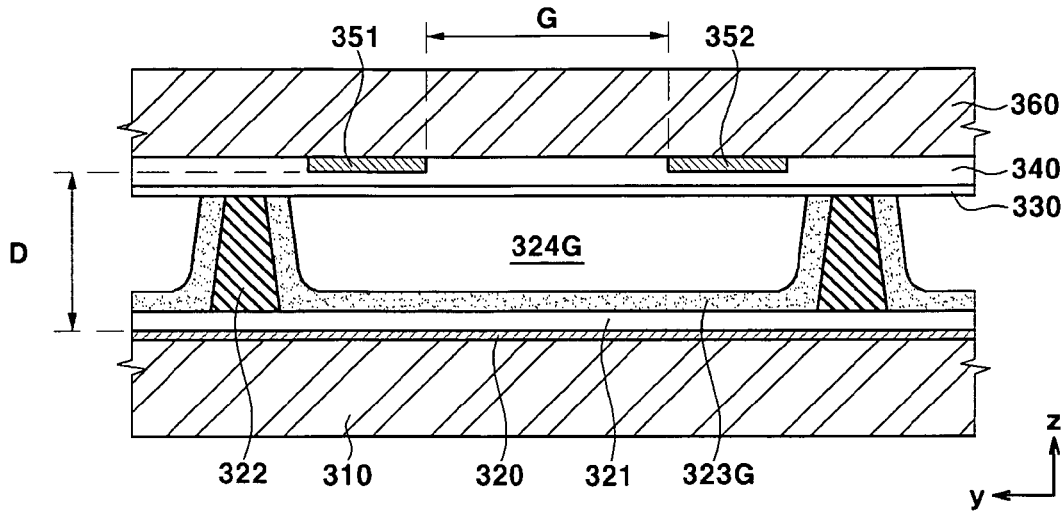
FIG. 4 is a cross-sectional view of an assembly of the PDP of FIG. 3.

Referring to FIG. 3 and FIG. 4, the PDP 300 includes a first substrate 310 and a second substrate 360 which are located opposite to each other with a predetermined distance therebetween, and a number of discharge cells 324R, 324G, and 324B are provided in spaces formed between the first and second substrates 310, 360. Visible rays are radiated from each of the discharge cells 324R, 324G, 324B by an independent discharge mechanism, thus implementing color images.

Address electrodes 320 are formed on the first substrate 310 along a first direction (a y-axis direction in the drawings). A first dielectric layer 321 is formed on the entire surface of the first substrate 310 while covering the address electrodes 320. The address electrodes 320 are formed in a striped pattern and there is a predetermined distance between two adjacent address electrodes 320.

Lattice-type barrier ribs 322 are formed on the first dielectric layer 321. Ribs or sides of the lattice-type barrier ribs 322 lie along the direction of the address electrodes 320 and along a second direction (a x-axis direction in the drawings) crossing the direction of the address electrode 320. The space between the first and second substrates 310, 360 is partitioned into the discharge cells 324R, 324G, 324B by the lattice-type barrier ribs 322. In addition, red, green, and blue phosphor layers 323R, 323G, 323B are formed on the four sides of the barrier ribs 322 and on the first dielectric layer 321. The shape of the barrier ribs 322 is not restricted to the rectangular lattice shown in FIG. 3. Rather, the barrier ribs 322 may be formed as lattices of other shapes or as stripes.

In addition, pairs of display electrodes 350 each pair including a scan electrode 352 and a sustain electrode 351 are formed on an inner surface of the second substrate 360 opposite the first substrate 310. The display electrodes 350 are formed along the second direction (the x-axis direction in the drawings) crossing the direction of the address electrodes 320. A transparent second dielectric layer 340 and a MgO protective layer 330 are formed on the inner surface of the second substrate 360 while covering the display electrodes 350. The transparent second dielectric layer 340 and the MgO protective layer 330 may be laminated on the inner surface of the second substrate 360.

In the present exemplary embodiment, a discharge gap G (see FIG. 4) between the scan electrode 352 and the sustain electrode 351 forms a so-called long discharge gap that is greater than a distance D (see FIG. 4) between the address electrode 320 and the display electrodes 350. Thus, the scan electrode 352 and the sustain electrode 351 are located near two ends of their respective discharge cells 324R, 324G, 324B with a long discharge gap G between the two electrodes 351, 352.

The scan electrode 352 and the sustain electrode 351 may be formed from Ag, having excellent conductivity, or from metal electrode layers Cr/Cu/Cr. Both of these materials are opaque.

Figure 5:
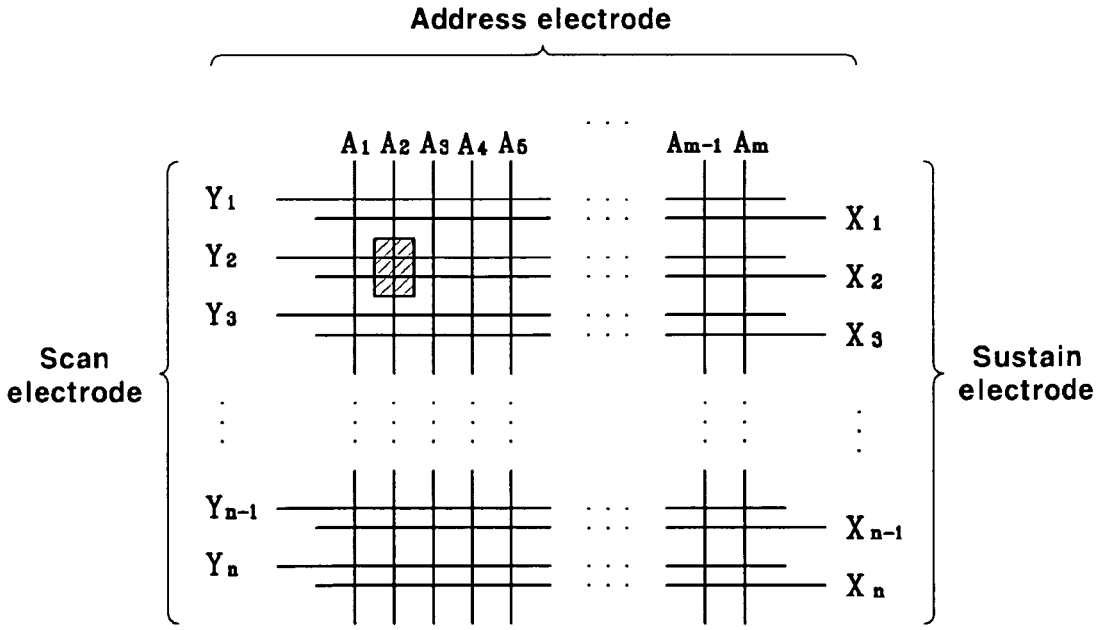
FIG. 5 is an electrode arrangement diagram of a PDP according to an exemplary embodiment of the present invention.

In addition, referring to FIG. 5, the electrodes of FIG. 3 and FIG. 4 are arranged in an n×m matrix format. The address electrodes A1 to Am extend in a column direction, and the scan electrodes Y1 to Yn and the sustain electrodes X1 to Xn extend in a row direction in pairs.

Figure 6:
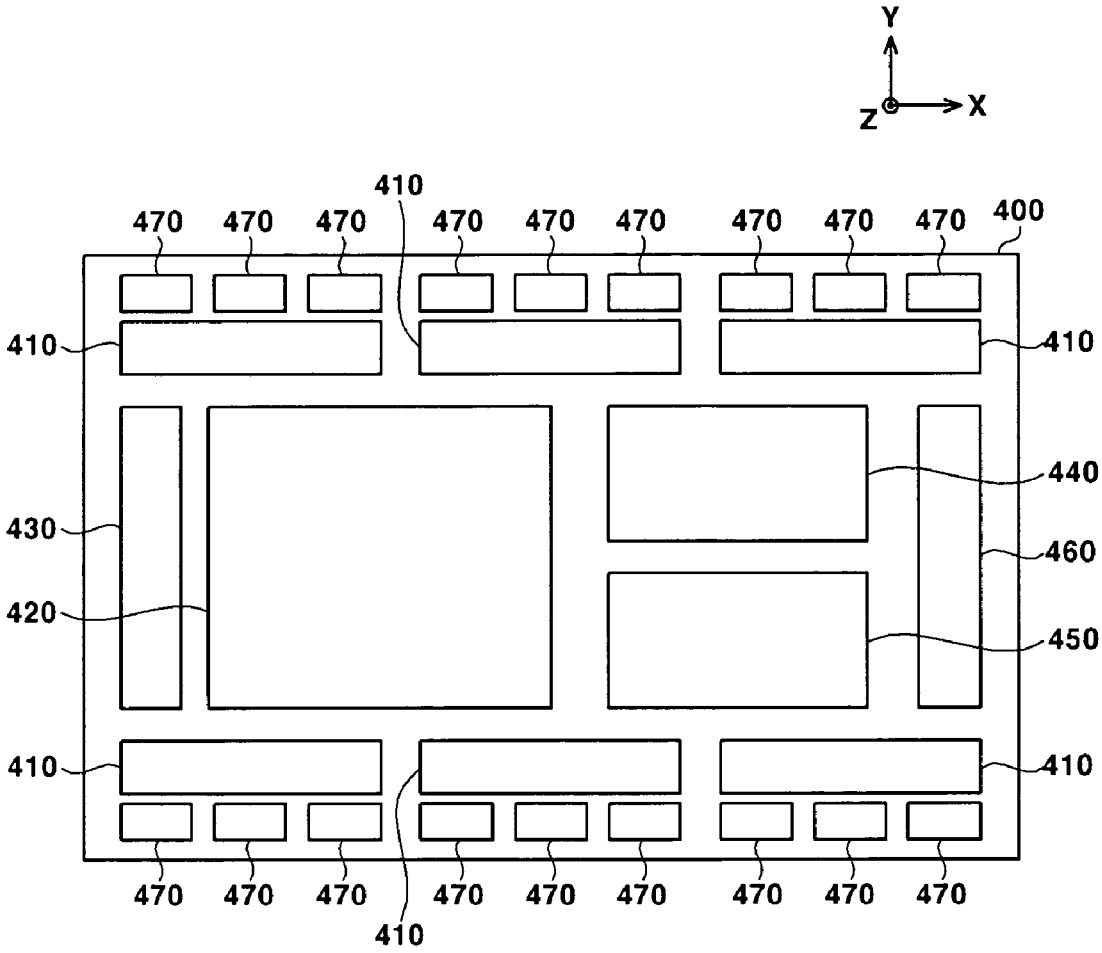
FIG. 6 is a schematic plan view of a chassis base according to an exemplary embodiment of the present invention.

As shown in FIG. 6, a plurality of driving boards 410 to 460 are formed on the chassis base 400 for driving the PDP 300.

Address buffer boards 410 may be formed as a single board or a combination of a plurality of boards. FIG. 6 exemplarily illustrates that the address buffer boards 410 are formed on the top and bottom areas of the chassis base 400. However, it is notable that such a configuration relates to a dual driving scheme. In a single driving scheme, the address buffer boards 410 are formed on either the top or the bottom areas of the chassis base 400. The address buffer board 410 receives an address driving signal from an image processing and controlling board 440 and applies a voltage for selecting a turn-on cell (i.e., a cell to be turned on) to the corresponding address electrodes A1 to Am.

A plurality of tape carrier packages (TCPs) 470 are formed on the top area of the respective address buffer boards 410 for transmitting signals from the address buffer boards 410 to the address electrodes A1 to Am. In addition, each TCP 470 includes an address driving IC for switching an address voltage to select the address electrodes A1 to Am during the address period. FIG. 6 exemplarily illustrates that the TCP 470 is formed on a rear surface of the chassis base 400. However, it is notable that the TCP 470 is in the form of a flexible tape in order to be capable of being coupled to the address electrodes A1 to Am. In one embodiment, the TCP 470 transmits the signal from the address buffer board 410 to the address electrodes A1 to Am and switches these electrode on, but the TCP can be replaced with another element that can be bent and installed with an IC.

A scan driving board 420 is shown in a left area of the chassis base 400, and is electrically coupled to the scan electrodes Y1 to Yn through a scan buffer board 430. During an address period, the scan buffer board 430 applies a voltage to the scan electrodes Y1 to Yn for sequentially selecting the scan electrodes Y1 to Yn. The scan driving board 420 receives a driving signal from the image processing and controlling board 440 and applies a driving voltage to the scan electrodes Y1 to Yn.

A sustain driving board 460 is provided in a right area of the chassis base 400, and is electrically coupled to the sustain electrodes X1 to Xn. The sustain driving board 460 receives a driving signal from the image processing and controlling board 440 and applies a driving voltage to the sustain electrodes X1 to Xn.

FIG. 6 exemplarily illustrates that the scan driving board 420 and the scan buffer board 430 are provided to the left in the chassis base 400, but they may be alternatively provided to the right. In addition, the scan buffer board 430 and the scan driving board 420 may be integrally formed as one component.

The image processing and controlling board 440 externally receives a video signal, generates a control signal for driving the address electrodes A1 to Am and a control signal for driving the scan and sustain electrodes Y1 to Yn and X1 to Xn, and applies the control signals to the address driving board 410 and the scan driving board 420. A power supply board 450 supplies a power source for driving the plasma display device. The image processing and controlling board 440 and the power supply board 450 may be provided in a central portion of the chassis base 400. In alternative embodiments, the arrangement of the various board 410, 420, 430, 440, 450, 460 on the chassis base 400 may be varied from the arrangement shown in FIG. 6 while maintaining an equivalent function.

In the PDP according to the exemplary embodiment of the present invention, a long discharge gap is formed between the scan electrode 352 and the sustain electrode 351 and a sustain discharge is generated between these electrodes 351, 352 during a sustain period such that a positive column discharge is generated, thereby improving luminous efficiency. However, in order to generate the positive column sustain discharge in such a PDP, a high level of discharge firing voltage and sustain discharge voltage are required.

A driving method for solving the above-mentioned problem will be described with reference to FIG. 6, FIG. 7, and FIG. 8. For convenience of description, a driving waveform applied to the address electrodes A1 to Am (hereinafter referred to as "A"), the sustain electrodes X1 to Xn (hereinafter referred to as "X"), and the scan electrodes Y1 to Yn (hereinafter referred to as "Y") during a sustain period of each subfield will now be described.

Figure 7:
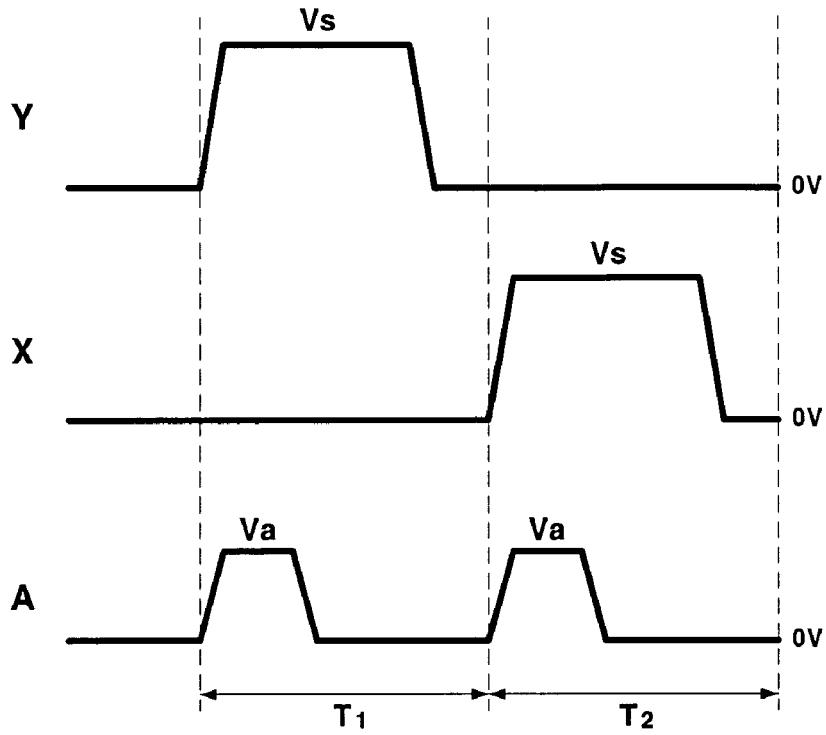
FIG. 7 is a driving waveform of a plasma display device according to a first exemplary embodiment of the present invention.
Figure 8:
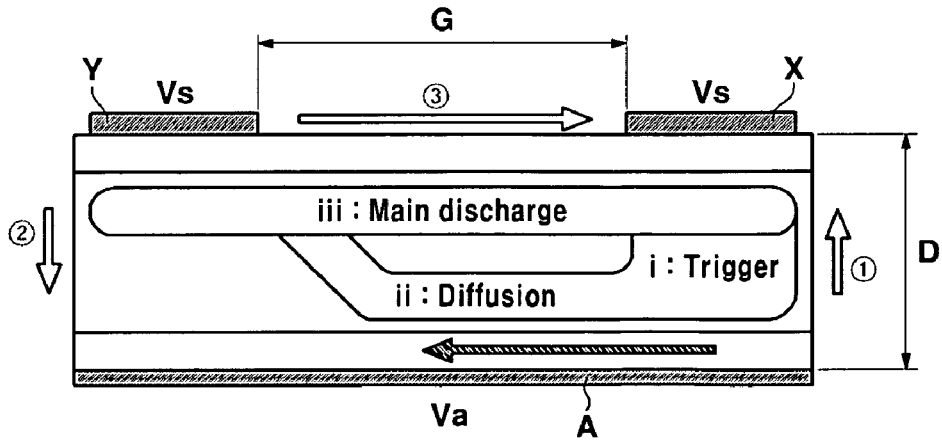
FIG. 8 schematically shows a discharge generation mechanism with application of the driving waveform of FIG. 7.

FIG. 7 is a driving waveform of a plasma display device according to a first exemplary embodiment of the present invention, and FIG. 8 schematically shows a discharge generation mechanism with application of the driving waveform of FIG. 7.

Referring to FIG. 7, each sustain period is divided into sub-periods T1, T2, and the like. The sub-periods T1, T2, and the like may be equal to one another. A discharge between the scan electrodes Y and the sustain electrodes X occurs during each sub-period T1, T2, and the remaining similar sub-periods that are not shown in FIG. 7. During the sub-period T1, a sustain discharge pulse voltage Vs is applied to the scan electrode Y while the sustain electrode X is biased with a reference voltage (ground voltage of 0V in FIG. 7). When the sustain discharge pulse voltage Vs is applied to the scan electrode Y, a voltage Va is applied to the address electrode A. However, a duration of applying the voltage Va to the address electrode A is shorter than a duration of applying the voltage Vs to the scan electrode Y.

When the sustain discharge pulse voltage Vs and the ground voltage (0V in FIG. 7) are respectively applied to the scan electrode Y and the sustain electrode X, trigger discharge i is first generated between the sustain electrode X and the address electrode A as shown in FIG. 8. In the present exemplary embodiment, the distance or gap G between the scan electrode Y and the sustain electrode X is greater than the distance D between the sustain electrode X and the address electrode A. Therefore, a discharge firing voltage between the scan electrode Y and the sustain electrode X is increased and a discharge firing voltage between the sustain electrode X and the address A is decreased such that the trigger discharge i is first generated between the sustain electrode X and the address electrode A by means of an electric field ①. Due to the trigger discharge, electrons are accumulated on the phosphor layer and the dielectric layer formed on the address electrode A so that the discharge diffuses along the address electrode A (ii: diffusion). The discharge is diffused toward the scan electrode Y so that a main discharge iii is generated between the scan electrode Y and the sustain electrode X. An electric field ② between the scan electrode Y and the address electrode A and an electric field ③ between the scan electrode Y and the sustain electrode X induce the discharge to be diffused along the address electrode A to the scan electrode Y. Accordingly, the main discharge iii is generated between the scan electrode Y and the sustain electrode X. In addition, the sustain electrode X is used as a cathode to attract ions to the MgO layer covering the dielectric layer below the sustain electrode, and a high secondary electron emission coefficient is induced by the ions. Therefore, the main discharge can be generated between the scan electrode Y and the sustain electrode X at a relatively low sustain discharge pulse voltage Vs.

The voltage Vs and the voltage Va should be set appropriately for conditions within a discharge cell in order to generate the main discharge between the scan electrode Y and the sustain electrode X after generating the trigger discharge between the address electrode A and the sustain electrode X by applying the voltage Va to the address electrode A and applying the reference voltage to the sustain electrode X while applying the voltage Vs to the scan electrode Y. Appropriate levels of the voltage Va and the voltage Vs can be experimentally selected.

Subsequently, during a sub-period T2, the voltage Vs is applied to the sustain electrode X while the scan electrode Y is biased with the reference voltage. During the sub-period T2, the voltage Va is applied to the address electrode A when the voltage Vs is applied to the sustain electrode X. The duration of the pulse of the voltage Va may be shorter than the duration of the pulse of voltage Vs. Detailed descriptions for trigger discharge, discharge diffusion, and main discharge generated for the sub-period T2 will be omitted because they are similar to those generated during the sub-period T1, except that the voltages applied to the sustain electrode X and the scan electrode Y are switched during the sub-period T2.

During the sustain period, the sustain discharge is generated by repeating the voltage applications of sub-periods T1 and T2.

As described, although a long discharge gap G exists between the electrodes, the sustain discharge pulse voltage Vs can be decreased by using the driving waveform according to the first exemplary embodiment of the present invention. However, the voltage Va is bring repeatedly applied to the address electrode A and thus the TCP 470 for transmitting a signal to the address electrode A may overheat. In the first exemplary embodiment, the waveform applied to the address electrode A periodically repeats the application of the voltage Va and the reference voltage to the address electrode A, and accordingly the TCP 470 transmitting this signal may overheat due to application of the current and frequent switching. In addition, the repetition of the application of the voltage Va and the reference voltage causes a switching loss of a switch in the TCP 470. A driving method that avoids this problem will be described hereinafter.

Figure 9:
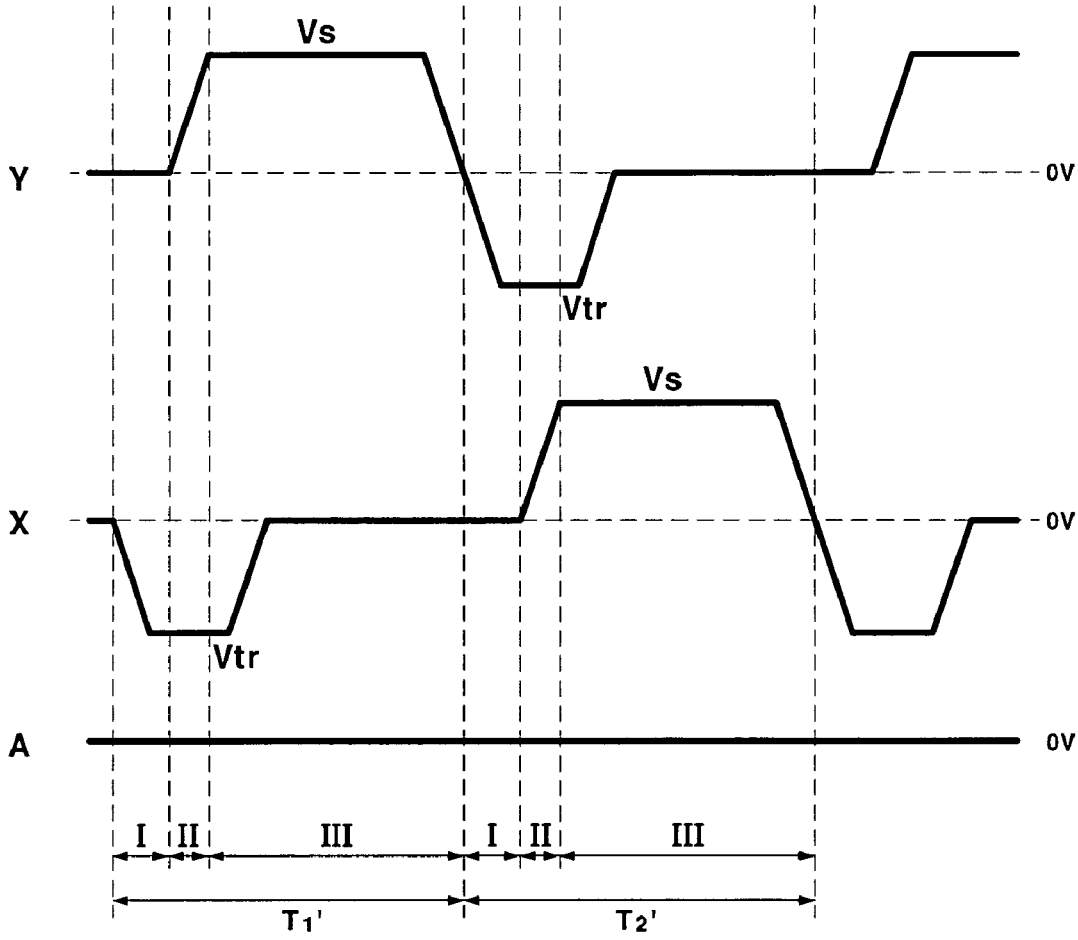
FIG. 9 shows a driving waveform of a plasma display device according to a second exemplary embodiment of the present invention.

FIG. 9 is a driving waveform diagram of a plasma display device according to a second exemplary embodiment of the present invention.

As shown in FIG. 9, during a sustain period, a predetermined voltage is applied to the scan electrode Y and the sustain electrode X while the reference voltage (0V in FIG. 9) is applied to the address electrode A. A discharge mechanism of the driving waveform of the FIG. 9 is similar to the discharge mechanism of the driving waveform of FIG. 7 that is shown in FIG. 8, except that while voltage pulses are being applied to the scan electrode Y and the sustain electrode X, the address electrode A is maintained at the reference voltage throughout the sustain period.

In FIG. 9, a sustain period is divided into sub-periods T1', T2', etc. A sustain discharge occurs during each of the sub-periods T1', T2', and other similar sub-periods of the sustain period. Each of the sub-period T1', T2', and the rest of the similar periods are in turn divided into time intervals I, II, and III. During the time interval I of a sub-period T1', a negative assistant pulse voltage Vtr is applied to the sustain electrode X while the address electrode A and the scan electrode Y are both biased with a ground voltage (0V in FIG. 9).

After a falling period of the negative assistant pulse voltage Vtr applied to the sustain electrode X is terminated at a point during the time interval I, the sustain electrode X is maintained at the negative assistant pulse voltage Vtr during any remaining portion of the time interval I and for the following time interval II. In this embodiment the negative assistant pulse voltage Vtr is assumed to be substantially equal to the sustain discharge pulse voltage Vs in absolute value. So, the sustain electrode X is maintained at the sustain discharge pulse voltage Vs for the duration of the time interval II. Therefore, first the negative assistant pulse voltage Vtr is applied to the sustain electrode X. After the application of the negative assistance pulse voltage Vtr has begun, then the sustain discharge pulse voltage Vs is applied to the scan electrode Y. In the embodiment shown, application of the sustain discharge pulse voltage Vs to the scan electrode Y continues after the falling period of the negative assistant pulse voltage Vtr has ended.

During the time interval I, electrons are accumulated on the phosphor layer and the dielectric layer formed on the address electrode A due to the trigger discharge i, and thus the discharge diffusion ii occurs along the address electrode A.

Subsequently, after a rising period of the negative assistant pulse voltage Vtr is terminated at some point during the time interval III, the sustain electrode X is biased with the reference voltage (0V in FIG. 9) while the scan electrode Y remains at the voltage Vs. As a result, during the time interval III, a voltage difference between the scan electrode Y, staying at the sustain discharge pulse voltage Vs, and the sustain electrode X, that is at the reference voltage, is maintained at the sustain discharge pulse voltage Vs. Therefore, after the discharge diffusion ii gives rise to the main discharge iii that is generated between the scan electrode Y and the sustain electrode X, the main discharge iii between the scan electrode Y and the sustain electrode X is maintained during the time interval III.

During a voltage switching period of the negative assistant pulse voltage Vtr applied to the sustain electrode X, a voltage difference between the sustain electrode X and the scan electrode Y corresponds to the sustain discharge pulse voltage Vs and a voltage difference between the scan electrode Y and the address electrode A corresponds to the negative assistant pulse voltage Vtr. The voltage differences between the sustain electrode X and the scan electrode Y and between the address electrode A and the scan electrode Y are the same, because in the exemplary embodiment being described the absolute value of Vtr equals the absolute value of Vs. However, the distance or gap G between the sustain electrode X and the scan electrode Y is greater than the distance D between the sustain electrode X and the address electrode A. Accordingly, as shown in FIG. 8, the trigger discharge i is generated between the address electrode A and the sustain electrode X across the shorter distance D before the main discharge iii is generated between the scan electrode Y and the sustain electrode X across the longer gap G.

In short, the trigger discharge i is generated at a point during the time interval I of the sub-period T1' and is followed by the diffusion discharge ii along the address electrode A during the time intervals I and II. The main discharge iii is generated after the trigger discharge i has been generated and may be generated at some point during the time intervals II or III. By the time, the time interval III of the sub-period T1' is reached, the main discharge iii is generated and maintained between the san electrode Y and the sustain electrode X by the application of the sustain discharge pulse voltage Vs to the scan electrode.

A discharge mechanism of a subsequent sub-period T2' is similar to the discharge mechanism of the sub-period T1', except that the voltages applied to the scan electrode Y and the sustain electrode X during the sub-period T1' are switched with each other during the sub-period T2'. That is, the trigger discharge is first generated between the scan electrode Y and the address electrode A, and the discharge is diffused along the address electrode A until the main discharge is generated between the sustain electrode X and the scan electrode Y.

The voltages Vs and Vtr are substantially equal in absolute value in the second exemplary embodiment of the present invention. However, the voltage Vs and the voltage Vtr can be experimentally set to be appropriate for the state of discharge cells.

Accordingly, in the second exemplary embodiment of the present invention, the address electrode A is biased with the reference voltage (0V) so that switching loss and overheating of the TCP can be prevented.

According to one of the above-described embodiments of the present invention, a positive bias voltage is applied to the address electrode while the sustain discharge voltage is applied to the scan electrode or the sustain electrode across the long discharge gap between the scan and sustain electrodes to improve discharge efficiency with a low discharge voltage.

Alternatively, a predetermined voltage is applied to the scan electrode and the sustain electrode while the address electrode is biased with the reference voltage to prevent a switching loss and overheating of the TCP that is providing current to the address electrodes.

While this invention has been described in connection with certain exemplary embodiments, it is to be understood that the invention is not limited to the embodiments described, but, on the contrary, is intended to cover various modifications and arrangements included within the spirit and scope of the appended claims and their equivalents.

What is claimed is:

1. A driving method of a plasma display device having a plurality of first electrodes, a plurality of second electrodes, and a plurality of third electrodes formed in a direction crossing a common direction of the first electrodes and the second electrodes, wherein a distance between the first electrodes and the second electrodes is greater than a distance between the first electrodes and the third electrodes, and wherein the plasma display device is driven during frames each divided into a plurality of subfields, each subfield including a reset period, an address period, and a sustain period, the driving method comprising, during the sustain period:

applying a voltage falling from a first voltage to a second voltage to a second electrode while a third electrode is biased with the first voltage;

after the application of the falling voltage, applying the second voltage to the second electrode for a predetermined period before applying a voltage rising from the second voltage to a third voltage to the second electrode; and applying a fourth voltage to the first electrode for generating a sustain discharge at a given point of the predetermined period.

2. The driving method of claim 1, wherein a sustain discharge is generated between the first electrode and the second electrode after a sustain discharge is generated between the third electrode and the second electrode.

3. The driving method of claim 1, wherein the second voltage is a negative voltage and the fourth voltage is a positive voltage.

4. The driving method of claim 1, wherein the first voltage equals the third voltage.

5. The driving method of claim 1, wherein the fourth voltage equals the second voltage in absolute value.

6. A driving method of a plasma display device having a plurality of first electrodes, a plurality of second electrodes, and a plurality of third electrodes formed in a direction crossing a common direction of the first electrodes and the second electrodes, the plasma display device driven during frames each frame including a sustain period, the sustain period being divided into a plurality of time intervals for generating a sustain discharge, the driving method comprising:

generating a trigger discharge between a first electrode and a third electrode by applying a second voltage that is lower than a first voltage to the first electrode during a first time interval while the third electrode is biased with the first voltage; and applying a third voltage that is higher than the first voltage to a second electrode at a time of starting a second time interval during which the first electrode is maintained at the second voltage, such that a discharge may diffuse along the third electrode and a main discharge may be generated between the first electrode and the second electrode, wherein the second time interval follows the first time interval and a sum of the first time interval and the second time interval is less than a third time interval during which the third voltage is applied to the second electrode.

7. The driving method of claim 6, wherein a distance between the first electrode and the second electrode is greater than a distance between the first electrode and the third electrode.

8. The driving method of claim 6, wherein, during a fifth time interval consecutive to a fourth time interval, the fourth time interval following the third time interval, the driving method comprises:

while the third electrode is biased with the first voltage, generating a trigger discharge between the second electrode and the third electrode by applying the second voltage that is lower than the first voltage to the second electrode; and applying the third voltage that is higher than the first voltage to the first electrode at a time of starting the fifth time interval such that a discharge may diffuse along the third electrode and a main discharge may be generated between the second electrode and the first electrode, wherein a sum of the fourth time interval and the fifth time interval is less than a sixth time interval during which the third voltage is applied to the first electrode.

9. A plasma display device comprising:

a plasma display panel having a first substrate, a plurality of address electrodes formed on the first substrate, a second substrate located opposite to the first substrate, and a plurality of scan electrodes and sustain electrodes formed in parallel on the second substrate in pairs; and a chassis base located opposite to the plasma display panel and having a driving board for transmitting driving signals for the address electrodes, the scan electrodes, and the sustain electrodes, wherein, during a sustain period, the driving board applies a second voltage that is lower than a first voltage to a sustain electrode and applies a third voltage that is higher than the first voltage to a scan electrode at a given point during the application of the second voltage to the sustain electrodes, while an address electrode is biased with the first voltage.

10. The plasma display device of claim 9, wherein a distance between the scan electrodes and the sustain electrodes is greater than a distance between the scan electrodes and the address electrodes or a distance between the sustain electrodes and the address electrodes.

11. The plasma display device of claim 9, wherein the first voltage is a ground voltage, the second voltage is a negative voltage, and the third voltage is a positive voltage.

12. The plasma display device of claim 9, wherein, during the sustain period, a discharge is generated between the scan electrode and the sustain electrode before a discharge is generated between the sustain electrode and the address electrode.

13. A driving method for a plasma display device having a plurality of first electrodes, a plurality of second electrodes, and a plurality of third electrodes formed in a direction crossing a common direction of the first electrodes and the second electrodes, a gap between the first electrodes and the second electrodes being greater than a distance between the first electrodes and the third electrodes and greater than a distance between the second electrodes and the third electrodes, driving time of the plasma display device divided into periods including a sustain period for sustaining a discharge generated within the plasma display device, the sustain period being divided into a plurality of sub-periods, each sub-period having a first time interval, a second time interval, and a third time interval being consecutive in time, the driving method during a first sub-period of the sustain period comprising:

maintaining the third electrodes at a first voltage;

lowering a voltage of a first electrode from the first voltage to a second voltage during a first time interval of the first sub-period;

maintaining the first electrode at the second voltage for duration of a second time interval of the first sub-period;

raising the voltage of the first electrode from the second voltage to a third voltage during a third time interval of the first sub-period;

raising a voltage of a second electrode from the first voltage to a fourth voltage during the second time interval of the first sub-period; and maintaining the first electrode at the third voltage and the second electrode at the fourth voltage during the third time interval for duration of a first overlap interval, wherein the third voltage is lower than the fourth voltage, and wherein the first overlap interval is longer than a sum of the first time interval and the second time interval of the first sub-period.

14. The driving method of claim 13, the driving method during a second sub-period either succeeding or preceding the first sub-period of the sustain period comprising:

maintaining the third electrodes at the first voltage;

lowering a voltage of the second electrode from the first voltage to the second voltage during a first time interval of the second sub-period;

maintaining the second electrode at the second voltage for duration of a second time interval of the second sub-period;

raising the voltage of the second electrode from the second voltage to the third voltage during a third time interval of the second sub-period;

raising the voltage of the first electrode from the first voltage to the fourth voltage during the second time interval of the second sub-period; and maintaining the second electrode at the third voltage and the first electrode at the fourth voltage during the third time interval of the second sub-period for duration of a second overlap interval, wherein the second overlap interval is longer than a sum of the first time interval and the second time interval of the second sub-period.

15. The driving method of claim 13, wherein the first electrodes are sustain electrodes, the second electrodes are scan electrodes, and the third electrodes are address electrodes, and wherein the driving time of the plasma display device is divided into frames of time, each frame being divided into a plurality of subfields, each subfield including a reset period, an address period, and the sustain period.

16. The driving method of claim 13, wherein the third voltage is equal to the first voltage.

17. The driving method of claim 13, wherein the first voltage is ground voltage.

18. The driving method of claim 13, wherein the second voltage is a negative voltage and the fourth voltage is a positive voltage.

19. A driving method for a plasma display device having a plurality of first electrodes, a plurality of second electrodes, and a plurality of third electrodes formed in a direction crossing a common direction of the first electrodes and the second electrodes, a gap between the first electrodes and the second electrodes being greater than a distance between the first electrodes and the third electrodes and greater than a distance between the second electrodes and the third electrodes, driving time of the plasma display device divided into periods including a sustain period for sustaining a discharge generated within the plasma display device, the driving method during the sustain period comprising:

applying a reference voltage to the third electrodes;

applying a sustain discharge pulse alternately to the first electrodes and the second electrodes, sustain discharge pulses being applied to the first electrodes not coinciding the sustain discharge pulses being applied to the second electrodes; and applying an assistant pulse to a first electrode following each sustain discharge pulse being applied to the first electrode, the assistant pulse beginning before a subsequent sustain discharge pulse being applied to a second electrode; and applying the assistant pulse to the second electrode following each sustain discharge pulse being applied to the second electrode, the assistant pulse beginning before a subsequent sustain discharge pulse being applied to the first electrode, wherein the sustain discharge pulse and the assistant pulse establish electric fields from the third electrodes and the second electrodes toward the first electrodes.

20. A driving method for a plasma display device having a plurality of first electrodes, a plurality of second electrodes, and a plurality of third electrodes formed in a direction crossing a common direction of the first electrodes and the second electrodes, a gap between the first electrodes and the second electrodes being greater than a distance between the first electrodes and the third electrodes and greater than a distance between the second electrodes and the third electrodes, driving time of the plasma display device divided into periods including a sustain period for sustaining a discharge generated within the plasma display device, the sustain period being divided into a plurality of sub-periods, the driving method during the sustain period comprising:

alternately applying a sustain voltage pulse to the first electrodes and the second electrodes during consecutive sub-periods of the sustain period; and applying an address voltage pulse to the third electrodes during every sub-period of the sustain period, the address voltage pulse beginning together with the sustain voltage pulse being applied to the first electrodes or the second electrodes during the sub-period, wherein the sustain voltage pulse and the address voltage pulse during each sub-period are both above or both below a common reference voltage level, and wherein duration and amplitude of the address voltage pulse are respectively shorter than duration and amplitude of a corresponding sustain voltage pulse.

* * * * *